US006834808B2

(12) United States Patent
Satou et al.

(10) Patent No.: US 6,834,808 B2
(45) Date of Patent: Dec. 28, 2004

(54) PAPER MONEY RECEIVING/DISCHARGING APPARATUS AND PAPER MONEY CONVEYER APPARATUS

(75) Inventors: Tadashi Satou, Chiyoda (JP); Riichi Katou, Nagoya (JP); Yasunari Niioka, Seto (JP); Hisahiro Koshizuka, Owariasahi (JP)

(73) Assignee: Hitachi, Ltd., Tokyo (JP)

( * ) Notice: Subject to any disclaimer, the term of this patent is extended or adjusted under 35 U.S.C. 154(b) by 59 days.

(21) Appl. No.: 10/372,793

(22) Filed: Feb. 26, 2003

(65) Prior Publication Data

US 2004/0065742 A1 Apr. 8, 2004

(30) Foreign Application Priority Data

Oct. 3, 2002 (JP) ..... 2002-290576

(51) Int. Cl.[7] ..... G06K 13/00
(52) U.S. Cl. ..... 235/475; 235/479
(58) Field of Search ..... 235/475–479, 235/381, 375, 379; 194/206; 271/216; 242/530.1, 532.3, 532.7, 528

(56) References Cited

U.S. PATENT DOCUMENTS 5,419,511 A * 5/1995 Takahashi et al. ..... 242/530.1
6,565,082 B2 * 5/2003 Sasaki et al. ..... 271/216
6,585,098 B2 * 7/2003 Satou et al. ..... 194/206
2002/0113160 A1 * 8/2002 Niioka et al. ..... 242/528

FOREIGN PATENT DOCUMENTS

JP 2000-123219 4/2000 ..... G07D/9/00
JP 02000348235 A * 12/2000

* cited by examiner

*Primary Examiner*—Thien M. Le
(74) *Attorney, Agent, or Firm*—Antonelli, Terry, Stout & Kraus, LLP

(57) ABSTRACT

A paper money receiving/discharging apparatus includes a reel for winding/rewinding a tape therearound, a wheel for winding/rewinding paper money together with the tape therearound, a holding conveyer for holding the paper money conveyed from outside of the paper money receiving/discharging apparatus, so as to convey the paper money in a direction of the wheel at a convey velocity, and an assist roller provided on a paper money conveyer passage between the holding conveyer and the wheel, abutting on the tape, to be rotatable following thereto, and for sending the paper money in a direction of being wound around the wheel while holding the paper money together with the tape. The tape is wound around the wheel at a velocity which is lower that the convey velocity of the paper money as conveyed by the holding conveyer.

20 Claims, 7 Drawing Sheets

PAPER MONEY RECEIVING/DISCHARGING APPARATUS AND PAPER MONEY CONVEYER APPARATUS

BACKGROUND OF THE INVENTION

The present invention relates to a paper money receiving/discharging apparatus for receiving and/or discharging a paper money therein/from, and a paper money conveyer apparatus for delivering or transferring the paper moneys therewith.

Conventionally, with a paper money receiving/discharging apparatus of a method, receiving paper moneys by winding them upon an outer surface of a wheel together with a tape, while discharging the paper moneys into an outside of a mechanism, which are received on the outer periphery surface of the wheel, by rewinding the tape back to the wheel, has an advantage that the mechanism thereof can be obtained with the simple structure, thereby being small in sizes and low in the cost. For example, in a patent document 1 mentioned below is disclosed a mechanism, in which a paper money guiding means is added to the structure for winding a central one-piece of tape around a wheel and a reel, thereby enabling high-speed processing of mixture of the paper moneys, being different in the sizes thereof, in particular, on the short side thereof. In the mechanism shown in this patent document 1 mentioned below, the delivery of the paper money, which is conveyed from an outside of the paper money receiving/discharging apparatus, is so conducted that the speed or velocity is increased a little bit at a receiving side thereof, as far as possible. Namely, the control of tape velocity of the paper money receiving/discharging apparatus is conducted in a such manner that: i.e., a rotating velocity of the wheel shaft is decelerated accompanying an enlargement of the wheel-winding radius or diameter, so that the tape velocity obtained through rotational driving of a wheel shaft is slightly increased than that of the convey speed within an outside of the mechanism, when receiving the paper money into the paper money receiving/discharging apparatus, or it is increased accompanying the reduction of the wheel-winding radius when discharging the paper money therefrom, and the tape velocity is slightly decelerated than the convey velocity on an outside covey passage when discharging the paper money from the paper money receiving/discharging apparatus, thereby obtaining a stability in performance of the delivery thereof.

The patent document 1: Japanese Patent Laying-Open No. 2000-123219 (JP-A 123219 (2000)), in particular, pages 4–5, and FIG. 1 thereof.

Thus, when delivering a piece of paper or the like, such as, the paper money, for example, from the necessity of protecting it from being buckled or jammed, ordinarily, such the control is made, that the velocity is increased at the receiving side a little bit, so as to avoid the so-called decelerated-delivery, even if delivering it at the same velocity. In the conventional art mentioned above, the control is made so that the accelerated-delivery can be obtained.

On a while, the paper money receiving/discharging apparatus of the winding method has a tendency that the diameter of the wheel winding is enlarged due to receipt of the paper moneys therein. For this reason, the larger the number of pieces of the paper moneys received therein, the wider the enlargement of width between the initial wheel diameter and the maximum winding diameter, thereby bringing the mechanism to be large in the sizes thereof. Also, for obtaining the receiving and discharging of the paper moneys, ordinarily, corresponding to change of the wheel-winding diameter, there is a necessity of providing a guide means for guiding the paper moneys, following to a convey angle defined between an outside portion of the mechanism and an outer periphery surface of the wheel changing, due to change of the wheel-winding diameter. Further, because of necessity of taking into the consideration, in particular, a space for receiving the enlargement in the wheel-winding diameter due to the receipt of paper moneys therein, it is impossible to provide such a fixed guide for paper moneys, and/or a conveyer roller, etc., in that space. For this reason, if the wheel diameter is large and the enlargement in width is also large on the wheel-winding diameter due to receipt of paper moneys therein, it is impossible to maintain a necessary holding force for conveyance, in particular, for a length greater than that of the paper money to be handled with, since-the conveyer roller providing the conveyer force on the paper money goes away from the holding point by the means of the tape on the wheel, in the distance therebetween.

From the fact mentioned in the above, the paper money receiving/discharging apparatus of the winding method has a limit in width of the wheel-winding diameter, which can be enlarged or expanded due to the receipt of paper moneys therein.

And, as was mentioned above, it is also necessary to make such the control, that the velocity is slightly increased at the receiving side of the paper money, in the delivery of the paper money conveyed therein, as far as possible.

Accordingly, there is the limit in the maximum wheel-winding diameter, and as a means for enlarging the receiving capacity of paper moneys therein, there can be considered a method, in which the paper moneys are received therein while narrowing the distances between them, so as to suppress the enlargement of the outer periphery surface of the wheel, however it is necessary to receive the paper money with decelerating the velocity thereof between an outside of the apparatus and the present apparatus, and also there is a provability of occurring the buckling, folding, etc., on the paper moneys during the delivery therebetween. Further, due to the difference in the velocity, a front end or tip portion of the following paper money hits on a rear end of the paper money, which was already received on the outer periphery surface of the wheel, thereby causing a drawback that the paper money is damaged.

SUMMARY OF THE INVENTION

For dissolving the drawbacks mentioned above, according to the present invention, there is to provide a paper money receiving/discharging apparatus, comprising: a reel for winding/rewinding a tape therearound; a wheel for winding/rewinding a paper money together with said tape therearound, while bringing a direction of winding/rewinding into a direction of a short side of the paper money; a holding conveyer means for holding the paper money conveyed from an outside of said paper money receiving/discharging apparatus, so as to send the paper money in a direction of said wheel; and an assist roller, being provided on a paper money conveyer passage between said holding conveyer means and said wheel, abutting on said tape, to be rotatable following thereto, and for sending the paper money in a direction of being wound around said wheel while holding the paper money together with said tape, wherein said tape is wound around the wheel at a velocity being lower that a convey velocity of the paper money by said holding conveyer means.

Also, for dissolving the drawbacks mentioned above, according to the present invention, there is provided a paper money receiving/discharging apparatus, comprising: a reel for winding/rewinding a tape therearound; a first roller rotating with abutting on the tape being wound/rewound on said reel; and a wheel for winding/rewinding a paper money, which is conveyed from an outside of the paper money receiving/discharging apparatus aligning in a direction of a short side thereof, together with the tape changed in a direction thereof by said first roller, whereby the paper money conveyed from the outside of the apparatus is received, by winding it together with the tape on an outer periphery surface of the wheel, while being held between said tape and said wheel through rotational driving of a shaft of said wheel, and the paper money is discharged into the outside of the apparatus through drive in reverse direction of the shaft of the wheel and rewinding drive of the tape to the wheel, further comprising:

a second roller, abutting on the tape, which is changed in a direction thereof by said first roller and wound around the wheel, between said first roller and said wheel, and thereby rotating following said tape;

a driving roller provided in a direction of said first roller from said second roller, to be driven thereby; and a following roller, abutting on said driving roller, and thereby rotating following said driving roller, wherein the paper money conveyed from the outside of the apparatus is held between said driving roller and said following roller, to be conveyed to a abutting surface between said second roller and said tape, said tape is made of a material of low friction coefficient, so that holding force by means of said second roller and said tape is equal to or lower than that between said driving roller and said following roller, the paper moneys conveyed from the outside of the apparatus are shifted in a distance therebetween at a ratio, between a convey velocity by rotational drive of said driving roller and said following roller for sending the paper money to the abutting surface between said second roller and said tape, and a convey velocity of said tape due to the rotational drive of the shaft of said wheel, and the paper money is received by being wound on the wheel while being held between the outer periphery surface of the wheel and the tape.

According to the structure mentioned above, it is possible to provide the paper money receiving/discharging apparatus, being enlarged in a receiving capacity of the paper moneys therein.

Further, according to the present invention, there is also provided a paper money coverer apparatus, comprising therein a plurality of holding conveyer means for holding and conveying the paper moneys, thereby conveying paper moneys by delivering the paper moneys between them, further comprising: a holding means, being provided between the holding conveyer means provided in an upstream side and the holding conveyer means provided in a downstream side, and having a friction coefficient being lower than that of said holding conveyer means.

With the structure mentioned above, it is possible to provide the paper money conveyer apparatus, enabling the decelerated/accelerated delivery, with preventing the paper money from the buckling and folding thereof.

BRIEF DESCRIPTION OF THE VARIOUS VIEWS OF THE DRAWING

Those and other objects, features and advantages of the present invention will become more readily apparent from the following detailed description when taken in conjunction with the accompanying drawings wherein.

Figure 4A:
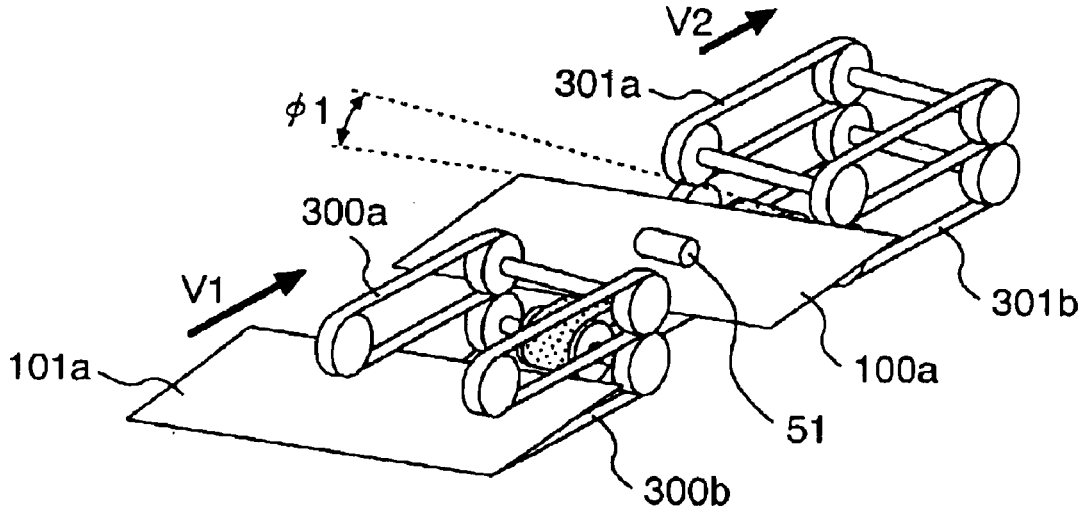
Figure 4B:
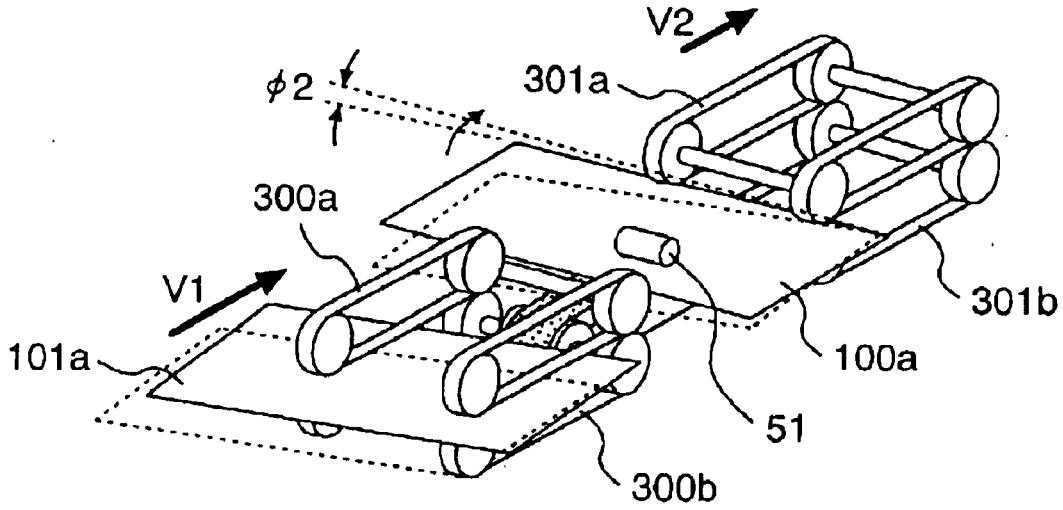
Figure 5:
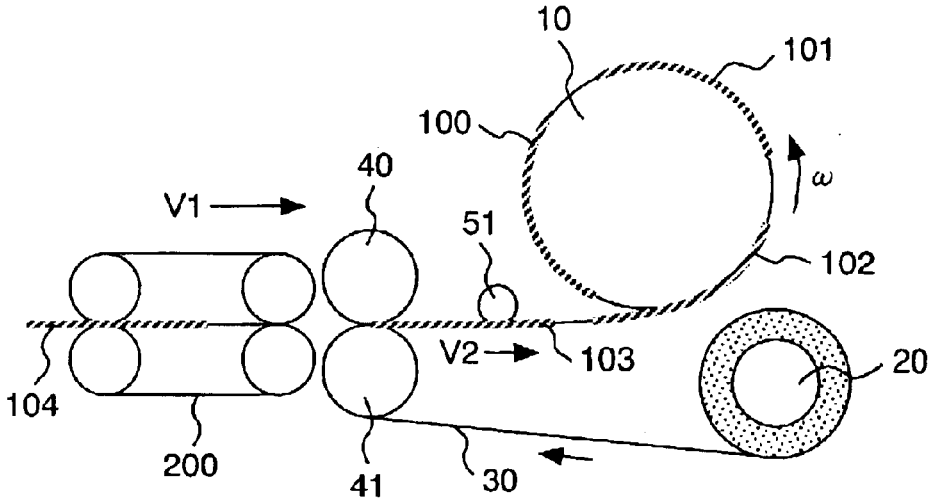
Figure 6:
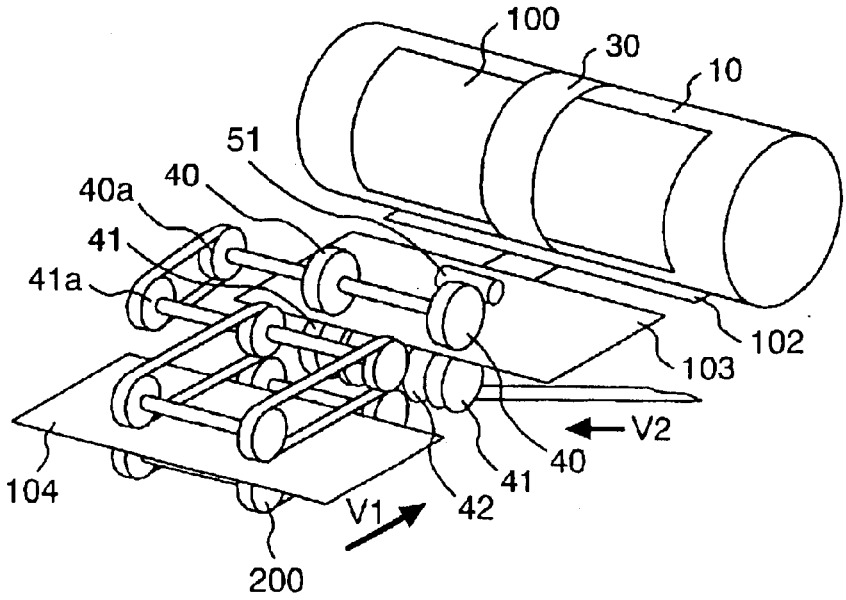
Figure 7:
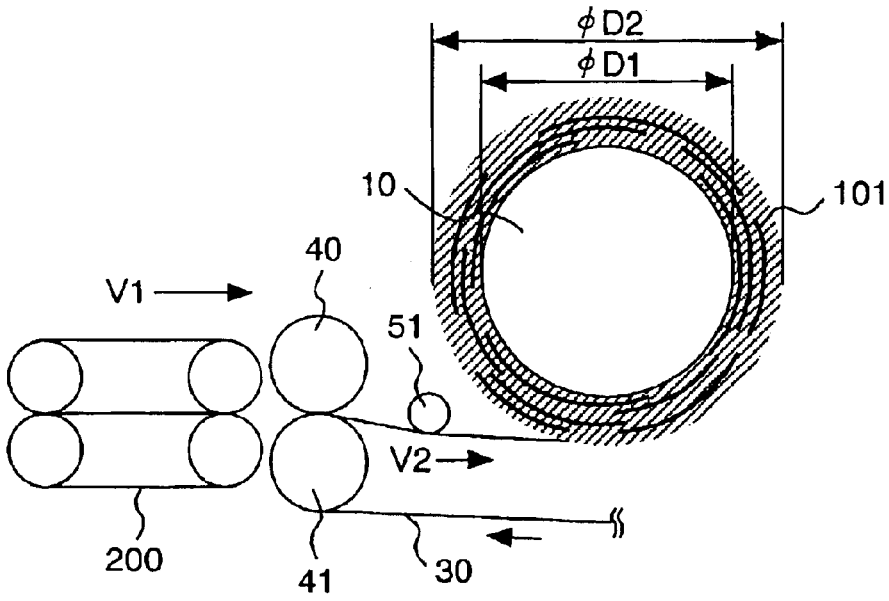
Figure 8A:
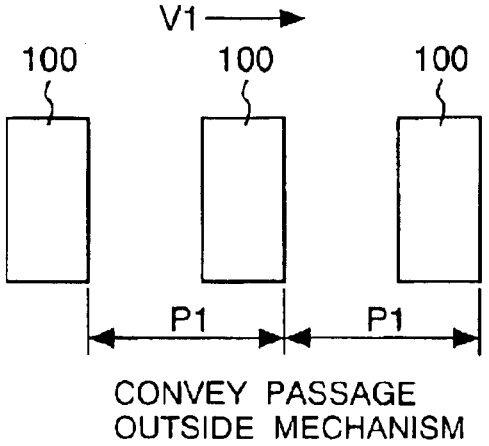
Figure 8B:
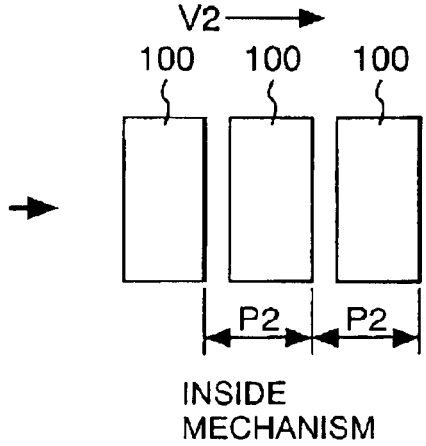
Figure 9:
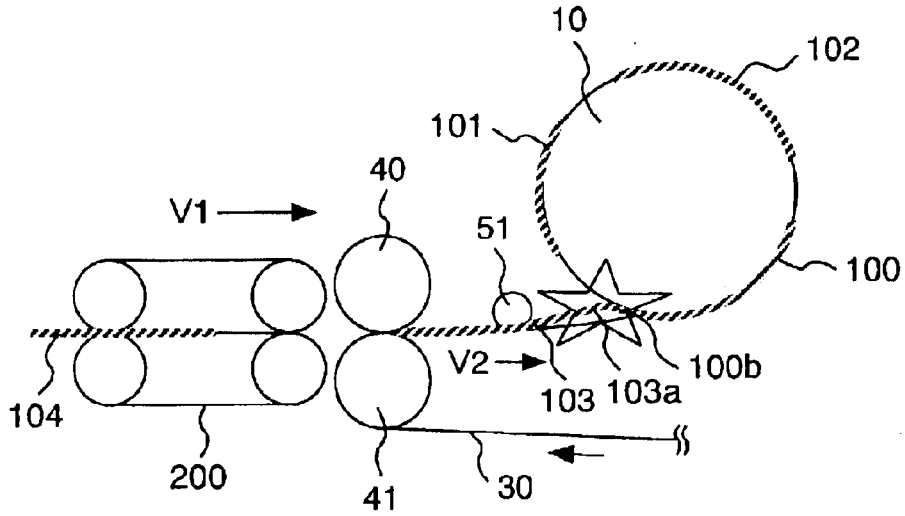
Figure 10:
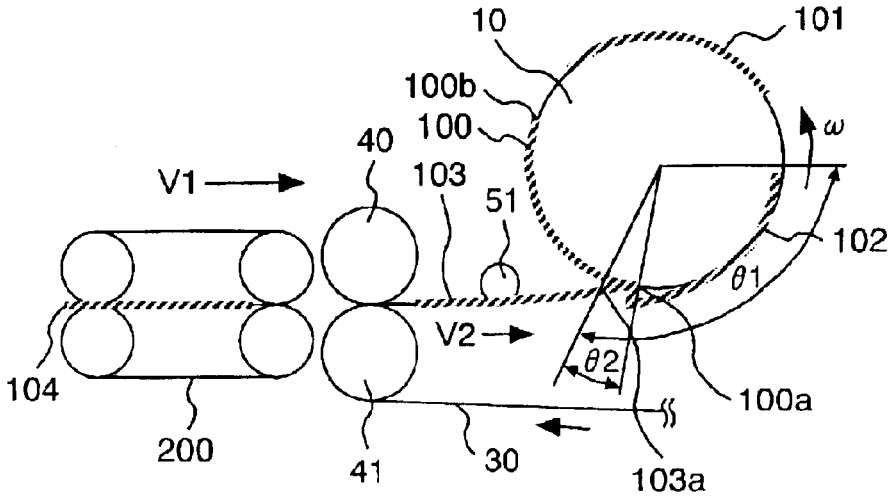
Figure 11:
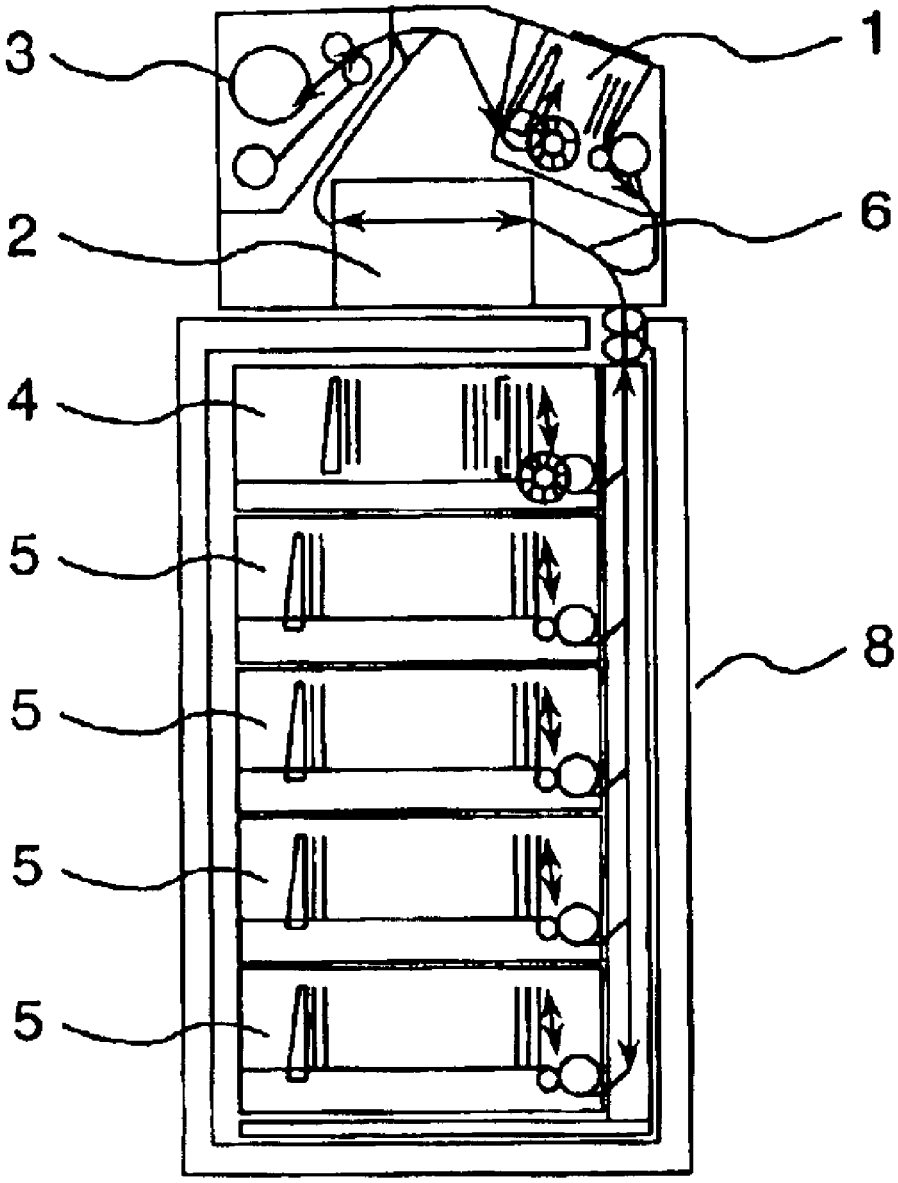

FIGS. 4(*a*) and 4(*b*) are views for showing the operation wherein the paper money, which is conveyed obliquely or in inclining condition, is corrected or aligned up in the direction thereof;

FIG. 5 is a side view of the paper money receiving/discharging apparatus (in an initial condition of receiving the paper moneys therein), according to the embodiment of the present invention;

FIG. 6 is an outline view of the paper money receiving/discharging apparatus (in the initial condition of receiving the paper moneys therein), according to the embodiment of the present invention;

FIG. 7 is an outline view of the paper money receiving/discharging apparatus (in the condition of receiving the paper moneys therein), according to the embodiment of the present invention;

FIGS. 8(*a*) and 8(*b*) are views for showing the changing in the distance between the paper moneys due to control of deceleration delivery;

FIG. 9 is a side view of the paper money receiving/discharging apparatus (when occurring an improper condition therein), according to the embodiment of the present invention;

FIG. 10 is a side view of the paper money receiving/discharging apparatus (for explaining a method of the deceleration delivery control), according to the embodiment of the present invention; and FIG. 11 is an outline view of a paper money handling apparatus (i.e., a cash vending machine), which installs therein the paper money receiving/discharging apparatus.

DETAILED DESCRIPTION OF THE INVENTION

Hereinafter, explanation will be made on an embodiment of the present invention, by referring to figures attached herewith.

FIG. 11 shows a side view of a cash vending machine 8, in which the present embodiment is applied to. Herein, explanation will be made on a flow of paper moneys when a customer deposits money therein. When the customer puts the mixture of various kinds of the paper moneys, being different in the sizes thereof, into a money receiving/discharging opening 1, in a lump sum, the moneys are separated by each piece within the money receiving/discharging opening 1, and are sent out by each. Each money paper sent out passes through a conveyer passage 6, and after being made discrimination of the kinds of money on it by means of an identification apparatus 2, it is stored temporality in a paper money receiving/discharging apparatus 3, under the condition of mixture of various kinds of moneys. When the transaction is established on the depositing via obtaining an approval by the customer on the amount of money, then the various kinds of paper moneys, which are stored within the paper money receiving/ discharging apparatus 3, are discharged from, passing through the conveyer passage 6, and are received into a flow cassette 5 or a depositing cassette 4 of the respective kinds of moneys, respectively.

Next, explanation will be made on payment. A predetermined number of pieces of the paper moneys in an amount thereof, which are designated by the customer, are separated from the respective flow cassettes 5 of the various kinds of paper moneys. Passing through the conveyer passage 6, the paper moneys separated from are discriminated on the money kinds thereof by means of the identification apparatus 2, and are conveyed to the money receiving/discharging opening 1, if being determined to be a normal note, to be paid to the customer. The paper money, which is decided to be improper for payment by identification apparatus 2, due to such as, the conveying condition and/or the condition of the paper money, etc., for example, is stored in the paper money receiving/discharging apparatus 3, contemporarily. After the transaction is established on payment, the paper moneys within the paper money receiving/discharging apparatus 3 are discharged from, passing through the conveyer passage 6, and then are received into the depositing cassette 4 or the flow cassette 5.

As was explained in the above, the paper money receiving/discharging apparatus 3, according to the present invention, is adopted as to be a temporary stocker for the automatic cash vending machine 8, in which the various kinds of paper moneys are stored, temporarily, before they are received into the depositing cassette 4 or the flow cassette 5.

Next, explanation will be made on a paper money conveyer apparatus for enabling the control on operation of the decelerated/accelerated delivery of the paper moneys.

Figure 1:
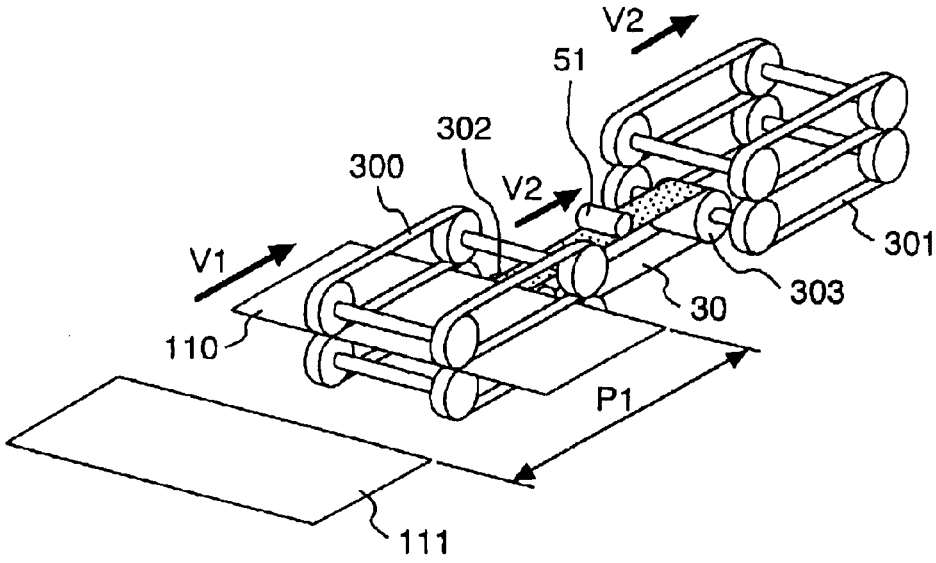
FIG. 1 is an outline view of a paper money conveyer apparatus, according to an embodiment of the present invention.

FIG. 1 is an outline view of the paper money receiving/discharging apparatus, according to an embodiment of the present invention. This is a conveyer mechanism for achieving the decelerated/accelerated delivery therewith, comprising: belt conveyer passages 300 and 301, which are aligned in an upstream side and a downstream side, as to be a holding conveyer means for conveying the paper moneys thereon, with holding them between the two (2) pieces of belts; e.g., upper and lower ones, each being wound around between rollers. Between those belt conveyer passages are provided intermediate rollers 302 and 303, respectively, wherein the intermediate roller 303 in the downstream side is fixed on a belt conveyer shaft, in a rotatable manner. On those intermediate rollers 302 and 303 are wound tapes 30 therearound, each having a low friction coefficient, and the intermediate roller 302 in the upstream side is provided on the belt conveyer shaft, but in a manner of enabling idle running therearound, and is rotationally driven via the tape 30 and the friction force on the contact surface with the intermediate roller 302. Further, at around a middle between those intermediate rollers 302 and 303 is provided an assist roller 51, which abuts on the surface of the tape 30 and rotates following therewith. Those assist roller 51 and the tape 30 build up a holding member for holding the paper money with the low friction force, and the paper money is held between the assist roller 51 and the surface of the tape 30, thereby being conveyed into the downstream conveyer belt 301. However, in the present embodiment, the assist roller 51 abutting on the surface of the tape 30 is so provided, that it contacts on the surface of the tape 30 with pressure, from a relationship with respect to the tension applied on the tape 30.

A gap or distance between the upstream belt conveyer passage and the downstream belt conveyer passage is built up to be equal to or greater than the maximum length of the paper moneys to be handled with. Namely, it can be said, even with the paper money of the maximum size, the said paper money comes out from the holding between both the belt conveyer passages 300 and 301, for instance.

Therefore, the paper money conveyed from the upstream is held between the assist roller 51 and the tape 30, thereby being delivered to the downstream belt conveyer passage 301. The holding force or power between the assist roller 51 and the tape 30 is built up with the tape 30, which is made of the low friction coefficient, to be lower than the holding force on the upstream belt conveyer passage 300 and the downstream belt conveyer passage 301. For this reason, if the convey velocities differ from each other in the upstream belt conveyer passage 300 and the downstream belt conveyer passage 301, because the holding force built up between the assist roller 51 and the tape 30 is low, then the paper money can be delivered from the upstream belt conveyer passage 300 to the downstream belt conveyer passage 301, without buckling or being damaged by stretching thereof, and at the same time, it is possible to shift and change the distance between the paper moneys. Further, preferably, the material of the tape 30 is one, which has small surface roughness, such as, a film made of plastic, etc., for example.

Figure 2:
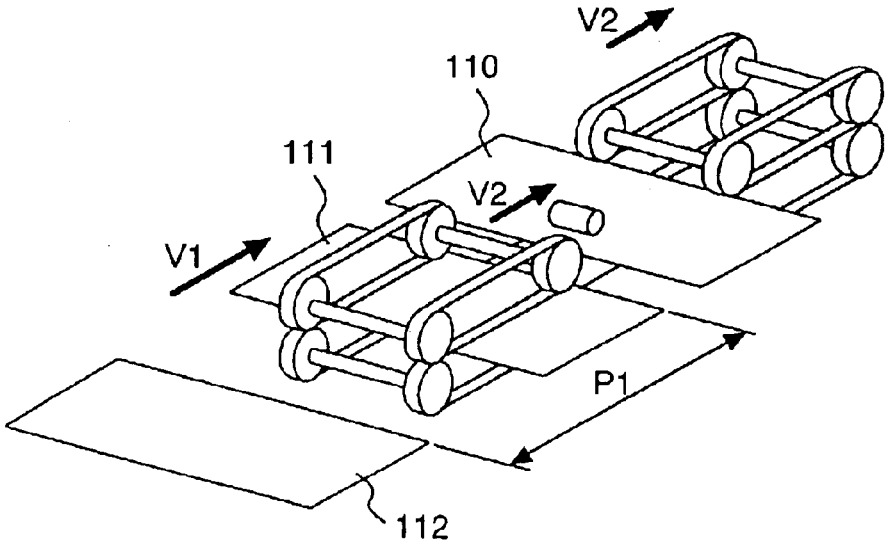
FIG. 2 is also an outline view of the paper money conveyer apparatus, according to the embodiment of the present invention.
Figure 3:
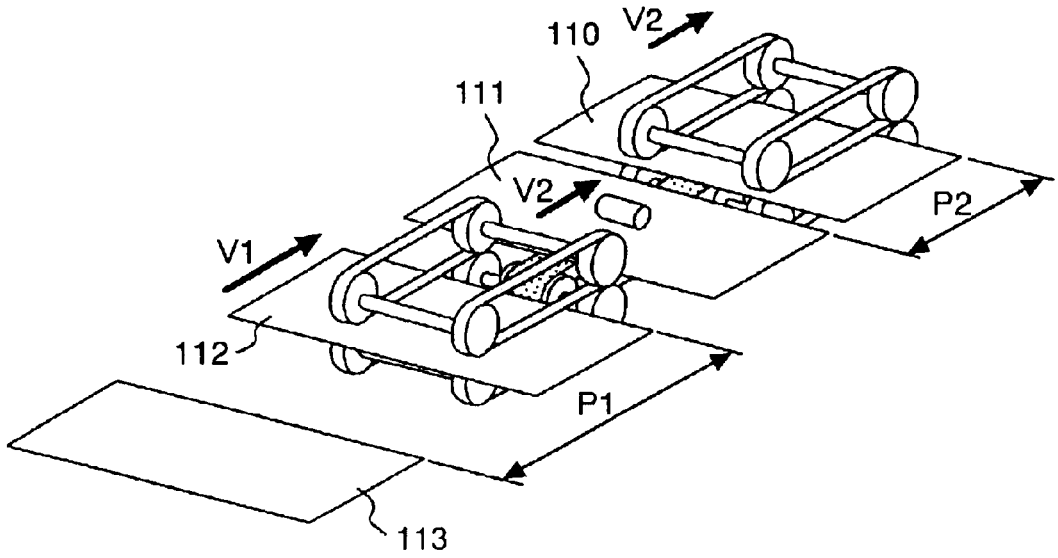
FIG. 3 is also an outline view of the paper money conveyer apparatus, according to the embodiment of the present invention.

Accordingly, as be shown in FIGS. 2 and 3, with the paper moneys 110 and 111, which are conveyed on the upstream belt conveyer passage at a distance P1 therebetween, it is possible to change the distance P2 between those paper moneys to be $(V2/V1)\times P1$ in the downstream side, through delivering thereof upon the upstream belt conveyer passage and the downstream belt conveyer passage, if assuming that the velocities of the upstream conveyer and the downstream conveyer are V1 and V2, respectively.

Also, when achieving the decelerated delivery control, wherein the carrying or convey velocity is faster on the upstream belt conveyer passage 300 than that on the downstream belt conveyer passage 301, it is possible to deliver the paper money, which is conveyed being tilted or in the inclined condition, on the upstream belt conveyer passage 300, to the downstream belt conveyer passage, through the distance between the upstream belt conveyer passage and the downstream belt conveyer passage, while turning back from the inclination thereof, between the upstream belt conveyer passage and the downstream belt conveyer passage.

FIGS. 4(*a*) and 4(*b*) show the operation, wherein the paper money conveyed while inclining or tilting is amended or corrected in the direction thereof. The paper money, which is conveyed with an inclination angle $\phi 1$ is transferred to a side of the downstream conveyer belt 301. According to the present embodiment, since the conveyer belts 300 and 301 are provided in plural numbers thereof in the direction of width on the convey passage, an end portion of the paper money in the downstream side of the convey direction comes to be in touch with a belt 301*b*, which builds up one of the downstream conveyer belt 301, before the other end portion of the paper money in the upstream side of the convey direction thereof comes out, completely, from the holding condition by means of a belt 300*a*, which builds up one of the upstream conveyer belt 300, (see FIG. 4(*a*)). When conducting the decelerated delivery, since the velocity V1 of the belt 300*a* and the velocity V2 of the belt 301*b* are in a relationship; i.e., $V1>V2$, therefore the paper money is turned in such a direction that the inclination is corrected around the said contact position, as shown in FIG. 4(*b*). With the rotation in this manner, the inclination angle comes to $\phi 2$, and then the paper money is conveyed into the downstream by the means of the downstream conveyer belt 301.

However, even in a case where the inclination thereof is small, so that the paper money touches on the belt 301*b* after coming outside completely from the condition of being held by the means of the belt 300*a,* the paper money is rotated, via the inertia force, in such a direction that the inclination can be corrected; thus, the inclination can be corrected though an amount of the corrected angle is not so large as in the case mentioned above.

The distance between the upstream and the downstream belt conveyer passages is made up to be equal to or greater than the maximum length of the paper money to be handled, in the carrying or convey direction thereof, so that there should be an instance when even the largest paper money comes to be outside the holding by means of both the belt conveyer passages 300 and 301, however for the inclined paper money, there may be a case where it is held by both the belt conveyer passages in the upstream side and the downstream side. However, in order to be corrected in the inclination thereof, it is necessary the paper money be held, not by means of the belts being on the same side in the direction of width on the conveyer passage (for example, the belt 300*a* and the belt 301*a*), but the belts being on the sides different from each other (for example, as was mentioned in the above, the belt 300*a* and the belt 301*b*), among the belts provided in the plural numbers thereof in the direction of width on the conveyer passage. In this instance, a moment is generated onto the paper money, so that the paper money is rotated to correct the inclination thereof. Namely, the upstream belt conveyer passage and the downstream belt conveyer passage are positioned at a predetermined distance provided therebetween, so that the paper money is not held by the both belts on the same side in the direction of width on the conveyer passage between the upstream belt conveyer passage and the downstream conveyer passage.

FIG. 5 is a side view of a paper money receiving/discharging apparatus of the winding type, in which is applied to the decelerated/accelerated delivery mechanism, according to the embodiment of the present invention, and FIG. 6 is a perspective view thereof.

Hereinafter, explanation will be given on the structure of the paper money receiving/discharging apparatus 3, according to the present embodiment. One end of the tape 30, which is fixed on and wound around a reel 20, is changed in the direction thereof via an outer periphery surface of an intermediate roller 42, which is provided as a first roller, and is fixed on an outer periphery surface of a wheel 10. The intermediate roller 42 is driven rotationally through the friction force between the tape 30, which is wound around the outer periphery surface thereof. With this mechanism, it is possible to receive therein the paper money 100 conveyed from an outside of the apparatus, by winding it on the outer periphery surface of the wheel 10 together with the tape 30, and therefore it is possible to receive the mixture of various kinds of the paper moneys, being different in the sizes thereof, together with one (1) piece of the tape 30.

On both sides of the intermediate roller 42 are positioned follower rollers 42, being provided to rotate idly on the shaft of the intermediate roller 42, and in an upper portion of the follower roller 41, a conveyer roller 40 is positioned while abutting on the follower roller 41. Those conveyer roller 40 and the follower roller 41 build up so-called a holding conveyer means for holding the paper moneys, so as to send them to the wheel 10, and are provided in plural numbers thereof in the direction of width on the conveyer passage. At an intermediate position between the conveyer roller 40 and the wheel 10 is provided an assist roller 51, as a second roller of rotating following thereto. On the outer periphery surface of this assist roller 51, the tape 30 is in contact with, and the assist roller 51 is driven rotationally through the frictional force between the tape 30.

However, the shafts of the wheel 10 and the reel 20 are connected to a motor, not shown in the figure, and on the shaft of the reel 20 is further provided a toque limiter, not shown in the figure. With provision of the motor for use of driving the shaft of the reel 20 through the torque limiter, it is possible to wind and rewind the tape 30 when receiving/discharging the paper money, under the condition of always applying the tension onto the tape 30.

Also, the shaft of the conveyer roller 40 is connected with the conveyer passage 200, which is provided in an outside of the mechanism, by means of a timing belt through a timing pulleys 40*a* and 40*b,* therefore it is driven rotationally, at the same velocity to the convey velocity V1 on the conveyer passage.

According to the conventional art, with the paper money 100, which is conveyed from the outside of the mechanism into the inside of the mechanism, by each one (1) piece thereof, at the convey velocity V1, in order to bring the tape velocity V2 due to rotation of the shaft of the wheel 10 to be equal to the convey velocity V1 in the outside of the mechanism (or a little bit accelerated), the control is made, so that the rotating velocity $\omega$ of the wheel shaft is decelerated gradually, corresponding to change on the winding diameter of the wheel, depending upon the number of pieces of the paper moneys received therein. Thus, the delivery of the paper moneys is conducted with such the control method that it brings the difference as small as possible, in particular, in the convey velocities between the outside of the mechanism and the present mechanism.

Also, the paper money receiving/discharging apparatus 3 of the winding method, as is shown in FIG. 7, the winding diameter of the wheel 10 is enlarged from $\phi 1$ up to $\phi 2$ due to receipt of the paper moneys therein of course, the more the number of the pieces received therein, the larger the diameter of the winding diameter of the wheel 10, and therefore, a distance or gap can be determined between the conveyer roller 40 and the follower roller 41, as well as, a limit on the number of pieces of paper moneys, which can be received therein, due to the distance between the conveyer roller 40 and the follower roller 41 and also the special restriction thereof with respect to the assist roller 51. Further, the length of the tape 30 must be long, and the winding diameter of the reel 20, on which the tape 30 is wound to be received, is also enlarged, therefore it brings the mechanism to be large in the sizes thereof. Also in the performances of discharging the paper moneys, the larger the width enlarged on the winding diameter of the wheel 10, the larger the change in the angle with respect to the convey surface of the paper money, advancing from the outer periphery surface of the wheel 10 to the convey surface in the outside of the mechanism, and therefore it gives ill influences on the delivery performance of the paper moneys.

In this manner, increasing in the number of pieces of the paper moneys received therein, thereby increasing the width of the winding diameter on the wheel 10, gives the ill influences on the performances, and a limit is determined on the number of pieces of the paper moneys, which can be received therein, including the special restriction thereof, etc.

The paper money receiving/discharging apparatus 3 of the winding method, which comprises the decelerated/ accelerated delivery mechanism according to the present embodiment therein, enables the delivery of the paper money between the outside of the apparatus and the present apparatus, while decelerating or accelerating, and therefore, as shown in FIGS. 8(*a*) and 8(*b*), is able to fluctuate or shift the distance P1 between the paper moneys, which are conveyed from the outside of the apparatus, into the distance P2 therebetween within the present apparatus, by the function of the rotation velocity ω of the wheel 10. If assuming that the convey velocity V2 of the tape 30 due to the rotating velocity ω of the wheel 10 is set to be lower than the convey velocity V1 in the outside of the apparatus, the paper moneys can be received by winding them on the outer periphery surface of the wheel 10 under the condition, i.e., (the distance P1 between the paper moneys in the outside of the apparatus)>(the distance P2 between the paper moneys in the present apparatus), thereby enabling to reduce the enlargement in the winding diameter ϕD2 of the wheel 10 due to the number of pieces of the paper moneys received therein. Or alternately, it is possible to increase the maximum number of pieces of the paper moneys, which can be received therein.

However, with the present paper money receiving/discharging apparatus, in which the paper money is handled on a short side direction thereof, the width of the tape is short, therefore it has a drawback that it bring about a problem if the distance or length comes to be longer, being defined from the holding edge of the paper money by means of the tape up to the corner of the paper money.

This is, in a case where the decelerated delivery is carried out between in the outside of the apparatus and the present apparatus, as shown in FIG. 9, there is a possibility that the edge or tip 103*a* of the paper money, which is conveyed from the outside of the apparatus into the present apparatus at the velocity, being higher than the convey velocity V2 of the tape 30 by the rotation velocity ω of the shaft of the wheel 10, hits on the rear end portion 100*b* of the paper money, which is already wound round the outer periphery surface of the wheel 10, thereby the paper money being damaged. For this reason, in the decelerated/accelerated delivery control, there is a necessity to control the rotating velocity of the shaft of the wheel 10, so that the drawback mentioned above can be avoided or escaped from.

Herein, explanation will be given on the control method for escaping from the drawback mentioned above, by referring to FIG. 10.

For avoiding the front edge 103 of the paper money, which approaches to the wheel 10 following the advancing paper money 100, from hitting on the rear edge 100*b* of the advancing paper money 100, which is wound around the wheel 10 to be received therein, the control is made in such a manner; i.e., the shaft of the wheel 10 is driven to rotate by θ1, during the time until when the front edge 103*a* of the following paper money 103 is received into the present apparatus, thereby the front edge is wound around in the rear by a predetermined angle θ2 from the front edge 100*a* of the paper money 100 upon the outer periphery surface of the wheel, which is piled up with the following paper money 103. Thus, it is possible to prevent the front edge 103*a* of the following paper money 103 from hitting upon the rear edge 100*b* of the advancing paper money 100 received on the outer periphery surface of the wheel 10, by driving the shaft of the wheel 10, sequentially, for each of the paper moneys which are conveyed therein from the outside of the apparatus.

The distance or gap is detected by means of a detection means not shown in the figure, between the paper moneys, which are conveyed into from the outside of the apparatus, continuously. The controller means, not shown in the figure, controls the rotation of the wheel 10, upon the basis of information relating to the distance or gap between the paper moneys, which is detected by means of the detection means.

Also, in a case where the distance P1 is a constant between the paper moneys, which are conveyed from the outside of the apparatus, it is enough to drive the rotation velocity ω of the shaft of the wheel 10 at a constant rotation irrespective of change in the winding diameter ϕD2 of the wheel 10, therefore it brings about an advantage that there is no necessity for conducting the complex control of changing depending on the enlargement in the winding diameter of the wheel 10.

The control when discharging the paper money into the conveyer passage within the outside of the apparatus, the wheel shaft is rotationally driven at the same velocity when receiving, in case of turning the distance or gap between the paper moneys back to that when receiving. It is also possible to shift or change the distance or gap between the paper moneys, freely, by the difference of velocities, in particular, between the rotation velocity of the wheel shaft and that on the convey passage in the outside of the apparatus.

Further, it is also possible to make such the correction in the inclination of the paper money coming in the inclining condition, as shown in FIGS. 4(*a*) and 4(*b*). In the paper money receiving/discharging apparatus, there may be caused the drawbacks; such as, interference between the paper money received in advance and the paper money following thereafter, if receiving the paper money(s) conveyed in the condition of being inclined, for example. According to the present embodiment, since the paper money conveyed can be corrected in the inclination thereof, therefore, it is possible to prevent it from such the drawback as was mentioned above.

In this instance, the position where the tape is wound on the wheel 10 corresponds to the holding conveyer means in the downstream side. Namely, in a case when the paper money conveyed under the inclined condition is held by both one of the pair of rollers among the plural numbers of roller pairs provided in the direction of width on the conveyer passage and the winding point on the wheel 10, a moment is generated in such the direction that the inclination is corrected with respect to the paper money conveyed in the inclining condition, therefore the inclination is corrected in the same manner to the example shown in FIG. 4.

As was mentioned in the above, explaining was made about the embodiments, according to the present invention, in the paper money receiving/discharging apparatus of the method of winding one (1) tape, being most simple in the structure thereof, the decelerated/accelerated delivery of the paper money is made possible between the outside of the mechanism and the present mechanism, thereby providing the paper money receiving/discharging apparatus, achieving an enlargement in the maximum number of the pieces of the paper moneys, which can received therein, as well as, the small-sizing of the mechanism thereof.

As was fully explained in the above, according to the present invention, with the paper money receiving/discharging apparatus of the method of winding one (1) tape, it is possible to obtain the paper money receiving/discharging apparatus, achieving an enlargement in the maximum number of the pieces of the paper moneys which can received therein, as well as, the small-sizing of the mechanism thereof. And, it is also possible to provide the paper money receiving/discharging apparatus, enabling the decelerated/accelerated deriver of the paper moneys, with preventing the paper moneys from being buckled and/or folded or broken down.

The present invention may be embodied in other specific forms without departing from the spirit or essential feature or characteristics thereof. The present embodiment(s) is/are therefore to be considered in all respects as illustrative and not restrictive, the scope of the invention being indicated by the appended claims rather than by the forgoing description and range of equivalency of the claims are therefore to be embraced therein.

What is claimed is:

1. A paper money receiving/discharging apparatus, comprising:

a reel for winding/rewinding a tape therearound;

a wheel for winding/rewinding paper money together with said tape therearound, while bringing a direction of winding/rewinding into a direction of a short side of the paper money;

a holding conveyer means for holding the paper money conveyed from outside of said paper money receiving/discharging apparatus, so as to convey the paper money in a direction of said wheel at a convey velocity; and an assist roller, being provided on a paper money conveyer passage between said holding conveyer means and said wheel, abutting on said tape, to be rotatable following thereto, and for sending the paper money in a direction of being wound around said wheel while holding the paper money together with said tape, wherein said tape is wound around said wheel at a velocity which is lower that the convey velocity of the paper money as conveyed by said holding conveyer means.

2. A paper money receiving/discharging apparatus, comprising:

a reel for winding/rewinding a tape therearound;

a first roller rotating with abutting on the tape being wound/rewound on said reel; and a wheel for winding/rewinding a paper money, which is conveyed from an outside of the paper money receiving/discharging apparatus aligning in a direction of a short side thereof, together with the tape changed in a direction thereof by said first roller, whereby the paper money conveyed from the outside of the apparatus is received, by winding it together with the tape on an outer periphery surface of the wheel, while being held between said tape and said wheel through rotational driving of a shaft of said wheel, and the paper money is discharged into the outside of the apparatus through drive in reverse direction of the shaft of the wheel and rewinding drive of the tape to the wheel, further comprising:

a second roller, abutting on the tape, which is changed in a direction thereof by said first roller and wound around the wheel, between said first roller and said wheel, and thereby rotating following said tape;

a driving roller provided in a direction of said first roller from said second roller, to be driven thereby; and a following roller, abutting on said driving roller, and thereby rotating following said driving roller, wherein the paper money conveyed from the outside of the apparatus is held between said driving roller and said following roller, to be conveyed to a abutting surface between said second roller and said tape, said tape is made of a material of low friction coefficient, so that holding force by means of said second roller and said tape is equal to or lower than that between said driving roller and said following roller, the paper moneys conveyed from the outside of the apparatus are shifted in a distance therebetween at a ratio, between a convey velocity by rotational drive of said driving roller and said following roller for sending the paper money to the abutting surface between said second roller and said tape, and a convey velocity of said tape due to the rotational drive of the shaft of said wheel, and the paper money is received by being wound on the wheel while being held between the outer periphery surface of the wheel and the tape.

3. A paper money receiving/discharging apparatus, as described in the claim 2, further comprising:

a detection means for detecting the distance between the paper moneys, which are conveyed one by one into the apparatus, continuously, in the outside of the apparatus, wherein the rotational drive of the shaft of said wheel is controlled on the distance between the paper moneys, which is detected by said detection means, so that a front end portion of a following paper money, which is piled on a precedent paper money, being received by being wound around the outer periphery of the wheel, is located a rear of a predetermined angle from the front edge of said precedent paper money.

4. A paper money receiving/discharging apparatus, comprising:

a reel for winding/rewinding a tape therearound; and a wheel for winding/rewinding a paper money together with said tape therearound, while bringing a direction of winding/rewinding into a direction of a short side of the paper money, wherein the paper moneys conveyed from the outside of said paper money receiving/discharging apparatus are wound around said wheel together with said tape, while bringing a distance to be narrowed between the paper moneys.

5. A paper money coverer apparatus, comprising therein a plurality of holding conveyer means for holding and conveying the paper moneys, thereby conveying paper moneys by delivering the paper moneys between them, further comprising:

a holding means, being provided between the holding conveyer means provided in an upstream side and the holding conveyer means provided in a downstream side, and having a friction coefficient being lower than that of said holding conveyer means.

6. A paper money coverer apparatus, as described in the claim 5, wherein said holding means having the low friction co efficient comprises:

a tape, being stretched between said holding conveyer means provided in the upstream side and said holding conveyer means provided in the downstream side, thereby forming a paper money convey surface while advancing in a convey direction of the paper moneys; and an assist roller, being abutting on said tape, and thereby to rotate following the advance of said tape.

7. A paper money coverer apparatus, as described in the claim 5, wherein a distance between said holding conveyer means provided in the upstream side and said holding conveyer means provided in the downstream side is longer than a side length of a paper money having maximum sizes, in a convey direction thereof.

8. A paper money coverer apparatus, as described in the claim 6, wherein a distance between said holding conveyer means provided in the upstream side and said holding conveyer means provided in the downstream side is longer than a side length of a paper money having maximum sizes, in a convey direction thereof.

9. A paper money coverer apparatus, as described in the claim 5, wherein said holding conveyer means is a belt conveyer passage for holing the paper money between the belts wound between the rollers, and said belts are provided in plural numbers thereof in a direction of width on the conveyer passage.

10. A paper money coverer apparatus, as described in the claim 6, wherein said holding conveyer means is a belt conveyer passage for holing the paper money between the belts wound between the rollers, and said belts are provided in plural numbers thereof in a direction of width on the conveyer passage.

11. A paper money coverer apparatus, as described in the claim 7, wherein said holding conveyer means is a belt conveyer passage for holing the paper money between the belts wound between the rollers, and said belts are provided in plural numbers thereof in a direction of width on the conveyer passage.

12. A paper money coverer apparatus, as described in the claim 8, wherein said holding conveyer means is a belt conveyer passage for holing the paper money between the belts wound between the rollers, and said belts are provided in plural numbers thereof in a direction of width on the conveyer passage.

13. A paper money coverer apparatus, as described in the claim 5, wherein said holding conveyer means provided in the downstream side is lower in a convey velocity thereof than that of said holding conveyer means provided in the upstream side.

14. A paper money coverer apparatus, as described in the claim 6, wherein said holding conveyer means provided in the downstream side is lower in a convey velocity thereof than that of said holding conveyer means provided in the upstream side.

15. A paper money coverer apparatus, as described in the claim 7, wherein said holding conveyer means provided in the downstream side is lower in a convey velocity thereof than that of said holding conveyer means provided in the upstream side.

16. A paper money coverer apparatus, as described in the claim 8, wherein said holding conveyer means provided in the downstream side is lower in a convey velocity thereof than that of said holding conveyer means provided in the upstream side.

17. A paper money coverer apparatus, as described in the claim 9, wherein said holding conveyer means provided in the downstream side is lower in a convey velocity thereof than that of said holding conveyer means provided in the upstream side.

18. A paper money coverer apparatus, as described in the claim 10, wherein said holding conveyer means provided in the downstream side is lower in a convey velocity thereof than that of said holding conveyer means provided in the upstream side.

19. A paper money coverer apparatus, as described in the claim 11, wherein said holding conveyer means provided in the downstream side is lower in a convey velocity thereof than that of said holding conveyer means provided in the upstream side.

20. A paper money coverer apparatus, as described in the claim 12, wherein said holding conveyer means provided in the downstream side is lower in a convey velocity thereof than that of said holding conveyer means provided in the upstream side.

* * * * *